United States Patent [19]

Trempala

[11] Patent Number: 4,567,741

[45] Date of Patent: Feb. 4, 1986

[54] SAFETY KEY HOLDER

[76] Inventor: Dohn J. Trempala, 213½ 42nd St., Newport Beach, Calif. 92663

[21] Appl. No.: 466,052

[22] Filed: Feb. 14, 1983

[51] Int. Cl.[4] ..... E05B 11/00

[52] U.S. Cl. ..... 70/389; 70/DIG. 57

[58] Field of Search ..... 70/389, 283, DIG. 57, 70/229, 232

[56] References Cited

U.S. PATENT DOCUMENTS

| | | | |
|---|---|---|---|
| 1,212,599 | 1/1917 | Ziehler et al. | 70/389 |
| 2,064,474 | 12/1936 | Hopkins | 70/389 |
| 3,599,454 | 8/1971 | Hill et al. | 70/283 X |
| 3,768,284 | 10/1973 | Kent et al. | 70/DIG. 57 |
| 4,148,092 | 4/1979 | Martin | 70/283 |
| 4,326,395 | 4/1982 | DeRosa | 70/DIG. 57 X |
| 4,367,827 | 1/1983 | Keller et al. | 70/389 X |
| 4,401,247 | 8/1983 | Zoor | 70/DIG. 57 X |
| 4,472,952 | 9/1984 | Hollowell, Jr. | 70/389 X |

FOREIGN PATENT DOCUMENTS

| | | | |
|---|---|---|---|
| 361011 | 10/1922 | Fed. Rep. of Germany | 70/DIG. 57 |
| 477618 | 10/1969 | Switzerland | 70/389 |
| 1456547 | 11/1976 | United Kingdom | 70/389 |
| 1500003 | 2/1978 | United Kingdom | 70/389 |
| 2045855 | 11/1980 | United Kingdom | 70/389 |
| 2106981 | 4/1983 | United Kingdom | 70/389 |

*Primary Examiner*—Gary L. Smith
*Assistant Examiner*—Lloyd A. Gall
*Attorney, Agent, or Firm*—Lothrop & West

[57] ABSTRACT

A primary key is retained in a public location until released by one factor, such as operation of a secondary key, and by a concurrent other factor, such as an electrical signal.

8 Claims, 11 Drawing Figures

FIG-3
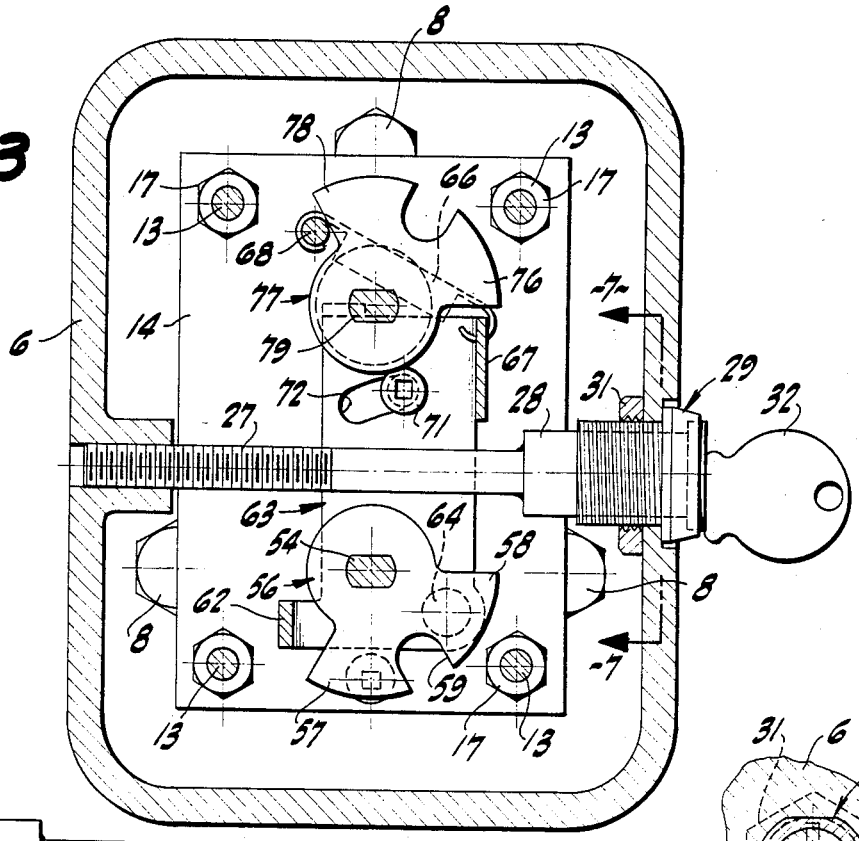
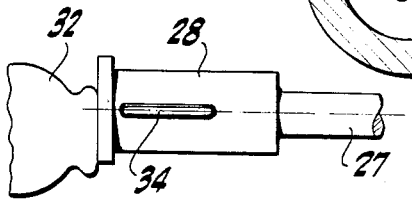
FIG-8
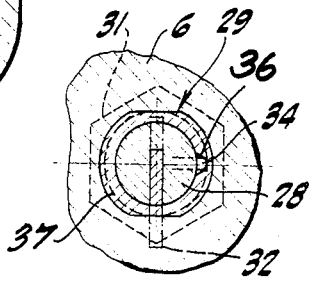
FIG-7
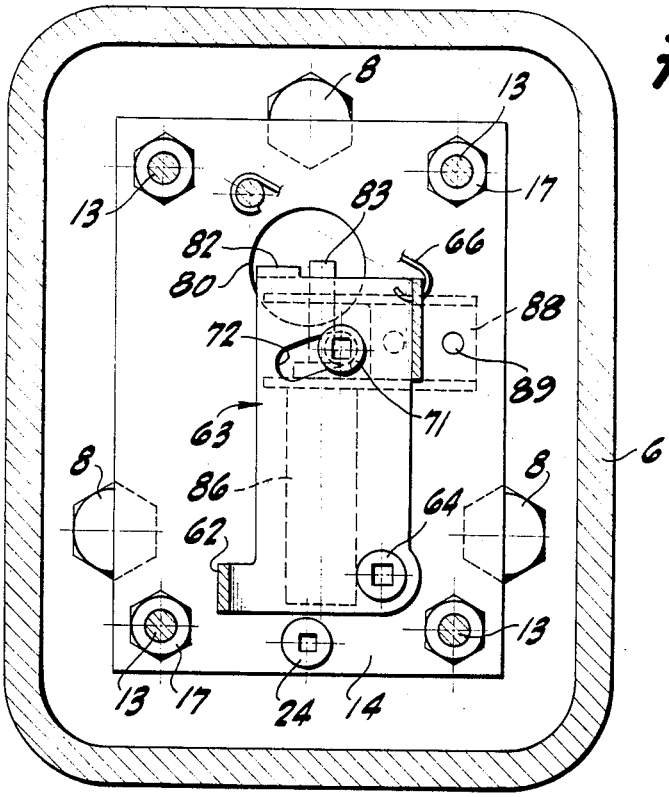
FIG-4

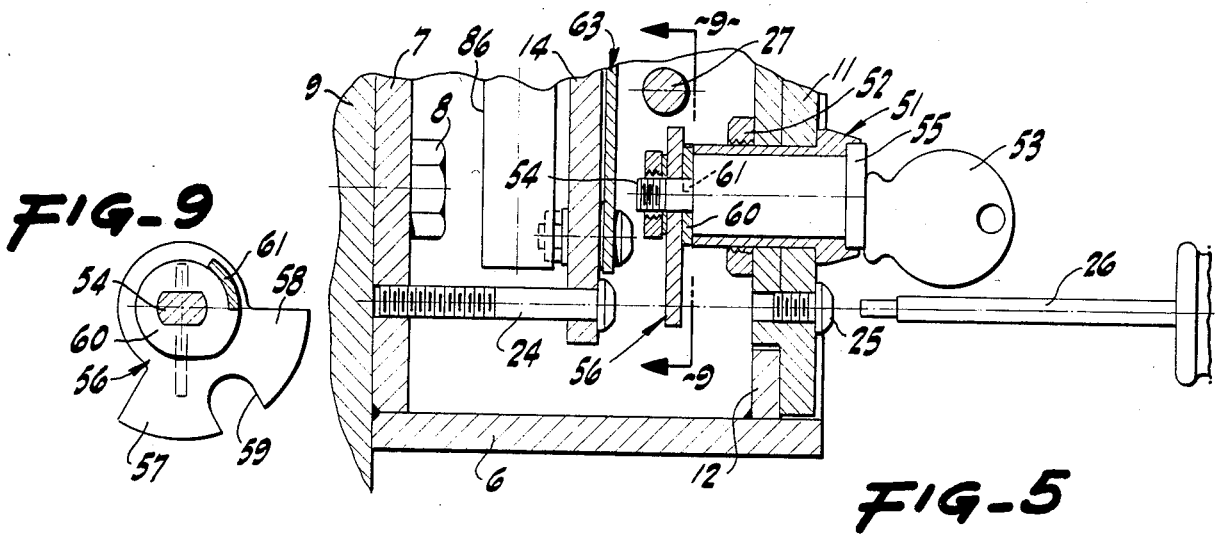
FIG-5
FIG-6
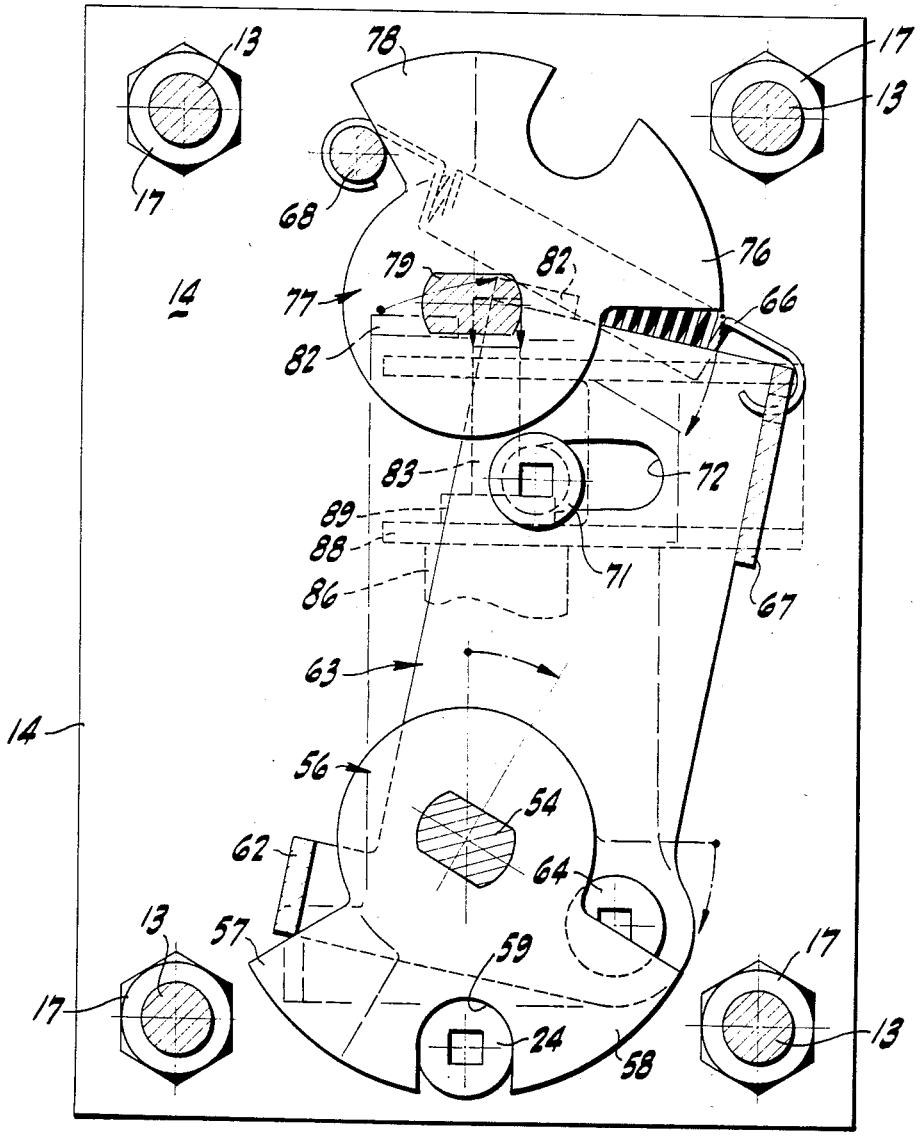

SAFETY KEY HOLDER

BRIEF SUMMARY OF THE INVENTION

The safety key holder is a retainer for a special or primary key to afford access to a remote enclosure. Included is a frame permanently mounted on an accessible exterior surface and having a retainer for a partly exposed primary key not removable from the retainer for use except upon concurrence of two events. One event is a partial release of the primary key by operation of a secondary key. The other event is the full release of the primary key by presence at the frame, concurrently with the secondary key operation, of an electrical signal from a remote point. Upon concurrence of the two indicated events, the primary key can be removed from the retainer.

BRIEF DESCRIPTION OF THE SEVERAL VIEWS OF THE DRAWINGS

FIG. 3 is a cross-section, the plane of which is indicated by the line 3—3 of FIG. 2.

FIG. 4 is a cross-section, the plane of which is indicated by the line 4—4 of FIG. 2.

FIG. 5 is a detail cross-section, the plane of which is indicated by the line 5—5 of FIG. 1.

FIG. 6 is a cross-section along the line 3—3 of FIG. 2 with certain portions omitted and to an enlarged scale.

FIG. 7 is a fragmentary cross-section, the plane of which is indicated by the line 7—7 of FIG. 3.

FIG. 8 is a side elevation of the structure shown in FIG. 7.

FIG. 9 is a cross-section, the plane of which is indicated by the line 9—9 of FIG. 5.

DETAILED DESCRIPTION

Figure 1:
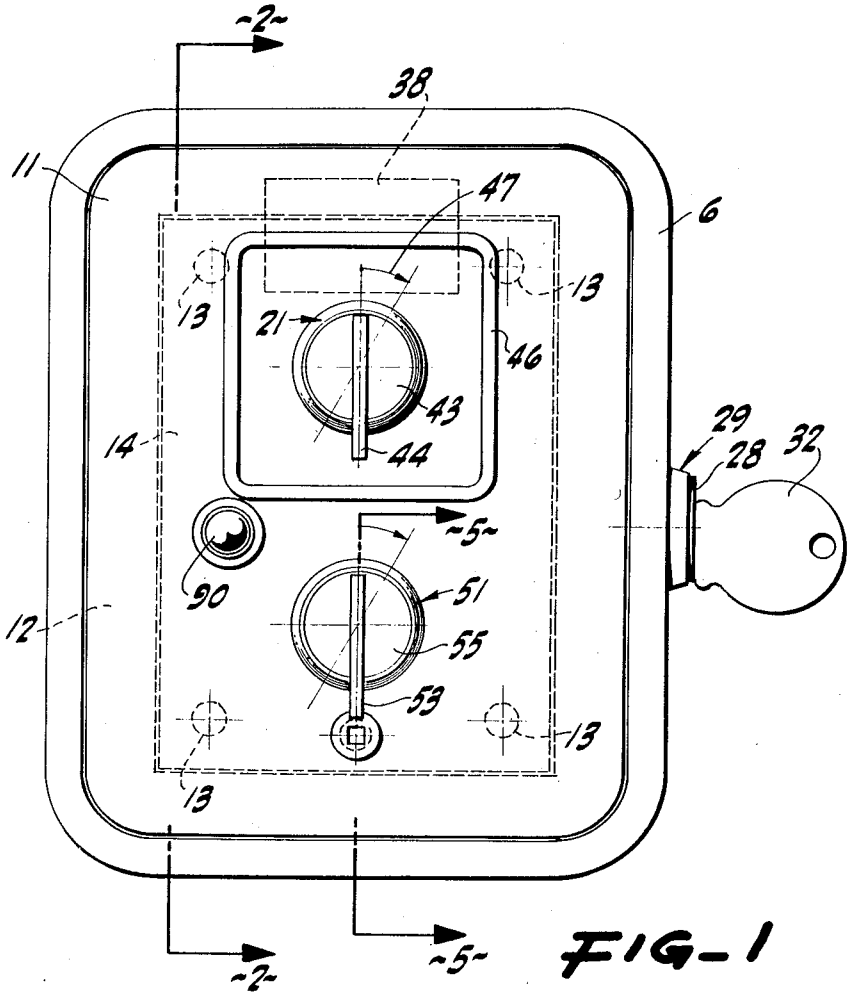
FIG. 1 is a front elevation of a safety key holder pursuant to the invention.

It is often desirable to afford emergency access to locked enclosures but only to those who are entitled to such access. For example, in the event a locked warehouse catches fire, it is helpful for the fire department to gain access to the warehouse by having an access key locally available. This is arranged herein by providing in an adjacent public location a fixture for retaining an access key but making it virtually impossible for anyone, not authorized, to remove the access key from its holder. Key access is afforded by partially releasing the access key by use of another secondary key regularly carried by a fireman and in addition by receipt at the primary, access key location of an electrical signal from the central firehouse.

Upon the simultaneous occurrence of the electrical signal and the use of the secondary or auxiliary key, the primary access key is released from its holder and can be withdrawn for use. The primary access key, although visible to the public, cannot be withdrawn from its holder except under the special, concurring circumstances noted.

As one form of structure for carrying out the indicated functions, there is provided a frame 6 or case. This is a small enclosure having an open side. This case is made up of relatively invulnerable material such as steel plate. There is included a securing plate 7 (FIG. 5) fastened by interior bolts 8 to an external supporting wall 9 at a convenient height and available location.

The frame 6 or case is also inclusive of a removable, duplex front plate 11 or panel of comparable material disposed in a slightly recessed position against a wall margin 12 to close the other side. The front plate 11 when in closed position protects the bolts 8 from external access.

Figure 2:
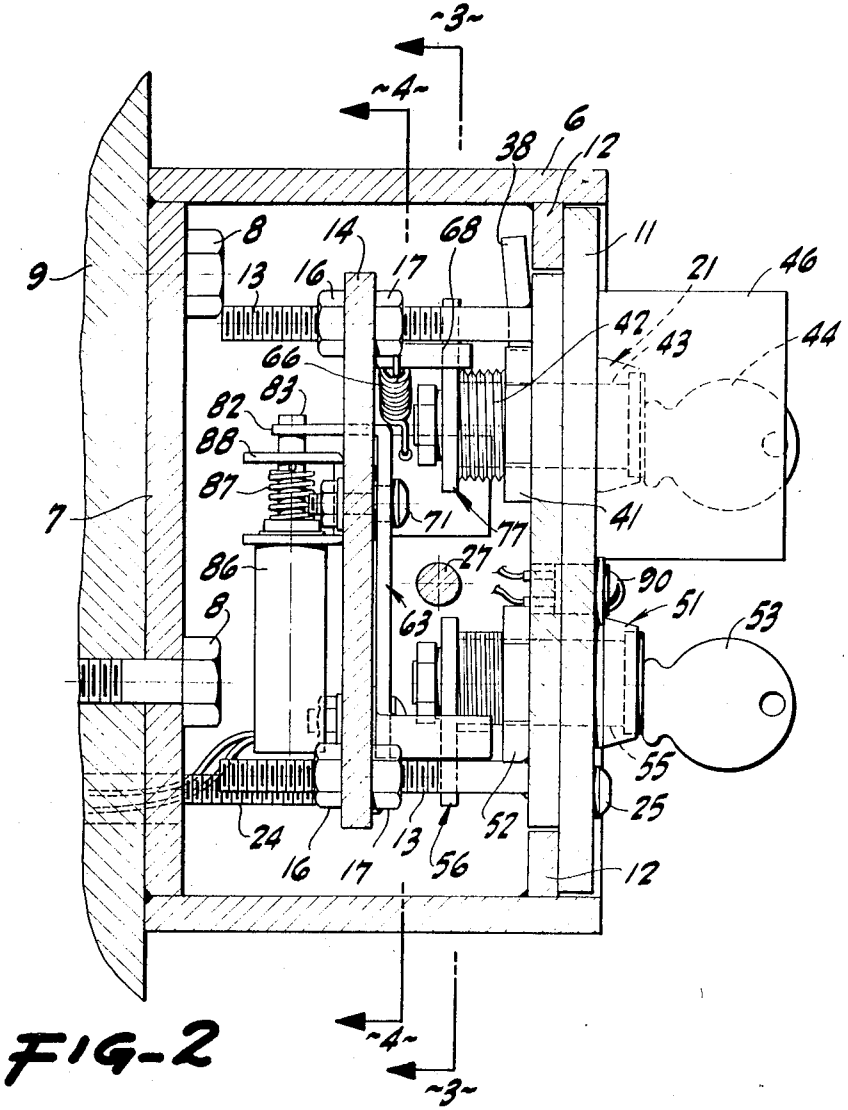
FIG. 2 is a cross-section, the plane of which is indicated by the line 2—2 of FIG. 1.

Extending into the interior of the enclosure from the front plate 11 are mounting studs 13 carrying an intermediate plate 14 adjustably held in position between jam nuts 16 and 17. The front plate 11 is held assembled to the frame 6 and against the flange 12 by a single screw 24 (FIGS. 2 and 5) having its head against the intermediate plate 14 and screwed into the securing plate 7 of the frame. To operate the screw 24, various pre-conditions are necessary. One is the removal of a separate, access screw 25 threaded into an opening through the front plate and engageable by a tool 26 (FIG. 5). Upon removal of the access screw 25, the tool 26 can engage the head of the screw 24 but only under certain circumstances or several pre-conditions.

When the single screw 24 is removed, the interior structure is detached from the casing 6. However, the so-detached interior mechanism (plate 14, etc.) cannot be removed from the enclosure of the frame because of the interfering presence of a barrier bolt 27 (FIGS. 3 and 5). This transversely extending bolt is screwed into an internal boss on one side wall of the frame. The bolt 27 is fastened to and rotates with the plug 28 of a service lock 29 having its housing 37 seated in the opposite side wall of the frame. The lock housing is held in position by an internal securing nut 31. When inserted, a removable service key 32 operates to rotate the plug 28 of the lock 29 as well as the bolt 27 at any time and through several revolutions.

As shown in FIGS. 7 and 8, when the service key 32 is in its normal upright position, the key can easily be inserted into and withdrawn from the plug 28. When the key 32 is rotated, there is simultaneous rotation of the lock plug 28. The first part of this rotation causes a detent bar 34 on the lock plug 28 to cam against the side of a notch 36 in the stationary lock housing 37 and to be depressed. When the detent bar 34 is so depressed, then the key 32 is axially locked into its keyway in the key plug 28 and cannot then axially be withdrawn, although it can rotate repeatedly in unison with the plug.

By such rotation of the key 32 and of the plug 28, the barrier bolt 27 is also rotated and unscrewed from the frame boss. The barrier bolt 27 and the key plug 28 can then be removed completely from the frame 6. The bolt 27 no longer acts as a barrier to removal of the contents of the frame. The front plate 11 and its attachments (except for a further condition) then have room to be withdrawn from the frame 6 simply by inclining the front plate 11 outwardly at the bottom to permit a tab 38 (FIG. 2) to disengage from under the adjacent portion of the margin 12 and so be removed. Conversely, when the parts are reassembled, the front plate 11 is put into position by inclining it and inserting the tab 38 behind and upwardly of the top part of the margin 12. The plate 11 is tipped upright and the fastening screw 24 is replaced by use of the tool 26. The trim screw 25 is replaced. The barrier bolt 27 can then be reintroduced and screwed back into place by continued rotation of the service key 32. When the bolt 27 and the service key 32 achieve home location, the detent bar 34 returns to its position in the notch 36, thus releasing the service key 32 for axial withdrawal from the key plug 28.

Secured in an opening in the front plate 11 by a lock nut 41 (FIG. 2) is a key housing 42 extending through an opening through the front plate and adapted to retain a primary key plug 43 for rotation by a primary or access key 44 under special circumstances. The key 44 is readily operable by a person's fingers but is largely guarded by a surrounding barrier 46 on the front plate 11 so that forcing tools cannot readily be applied thereto. The lock mechanism within the key housing 42 is of the same type of construction as shown and described in connection with the service key 32 shown in FIGS. 7 and 8. The key 44 is arranged so that in its normal upright, vertical position, as shown in FIG. 1, the key cannot be removed from its primary lock. Upon rotation of the key 44 and its plug 43 through a small arc 47 (FIG. 2) to the right, the key can be axially withdrawn from its lock plug 43. Unless the primary key 44 can be turned out of its normal, vertical position, it is retained against unauthorized withdrawal.

Means are provided for precluding rotation of the key 44 except upon the occurrence of several, predetermined circumstances.

One factor for holding the key 44 against release is a secondary lock 51 available at the front of the frame and mounted in the front plate 11 by a lock nut 52. The secondary lock 51 is of the same nature as the primary lock or the service lock shown in FIGS. 3, 7 and 8. When a secondary key 53 is introduced axially into the plug 55 of the lock 51, the key can readily be withdrawn prior to any plug rotation. But upon rotation of the lock plug 55 by the secondary key 53, the key 53 is retained in axial position until the secondary key is restored to its initial, vertical attitude.

Rotation of the plug of the secondary lock 51 produces rotation of a flattened bar 54 (FIGS. 3, 6 and 9) carrying a special movable means cam plate 56 having a pair of lobes 57 and 58 between them defining a recess 59. Motion of the plug 55 is limited by a cam disc 60 on the bar 54 and arranged to engage a stationary detent 61 (FIG. 9) projecting axially from the housing of the lock 51. In the usual, locked position of the cam plate 56, as shown in FIGS. 3 and 5, one of the lobes 57 is in a position overlying the head of the screw 24, so that unless the key 53 is first inserted and rotated, the screw 24 is not accessible to the tool 26. When the key 53 is in position and is rotated, then the lobe 57 is swung aside (FIG. 6) and ready access to the screw 24 can then be had by the tool 26 extending though the recess 59. Along with removal of the barrier bolt 27 as one condition, the cam lobe 57 must be swung aside, as another condition, before the plate 14 and its supported devices can be removed as described above.

Rotation of the key bar 54 from the normal position shown in FIG. 3 to a rotated position as shown in FIG. 6 not only uncovers the head of the fastening screw 24, but also causes the rotated lobe 57 to abut against the edge of and lift a tang 62 on a pivot plate 63 mounted for swinging movement with respect to the intermediate plate 14 by a pivot screw 64. Normally, the pivot plate 63 is moved into and stays in its FIGS. 4 and 10 position under the urgency of a coil spring 66. One spring end is hooked into a tang 67 on the pivot plate 63, and the other spring end is engaged around A stud 68 upstanding from the intermediate plate 14.

Figure 10:
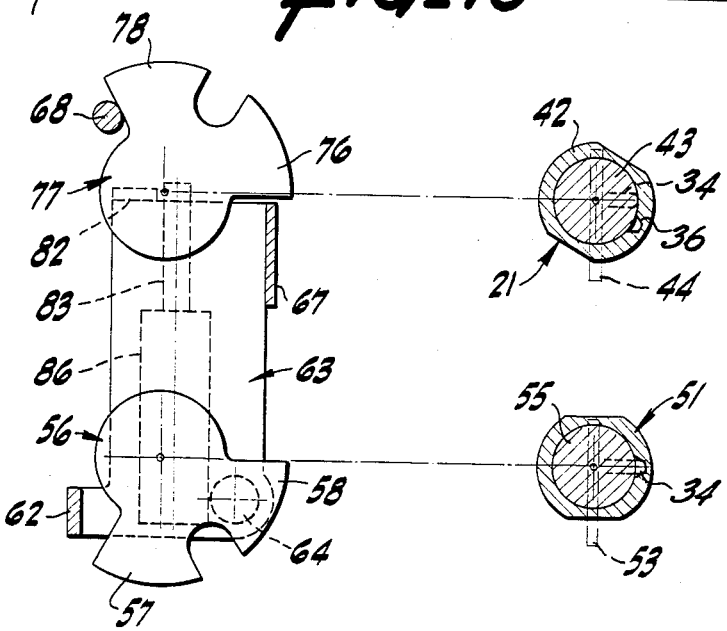
FIG. 10 is an exploded view partially in elevation and partially in cross-section, the plane of which is indicated by the line 3—3 of FIG. 2.

When the spring 66 alone is effective upon the intermediate plate 63, the plate is in a position as shown in FIGS. 3, 4, and 10, for example. The extent of swinging movement of the pivot plate 63 is governed by a limit stud 71 (FIGS. 2, 3 and 6) received through an arcuate slot 72 in the pivot plate 63 and mounted in the intermediate plate 14. The spring 66 normally holds the plate 63 substantially upright with one end of the slot 72 against the stud 71 (FIG. 3).

Figure 11:
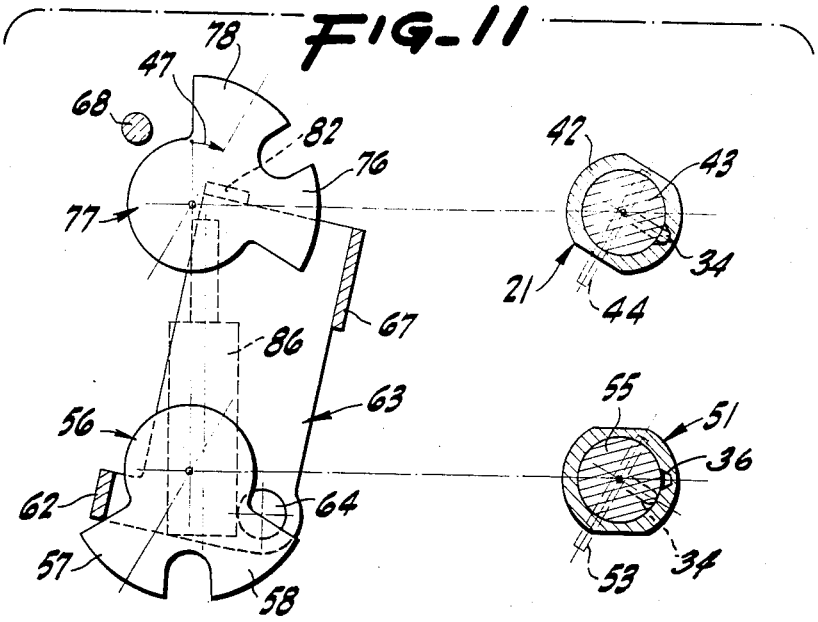
FIG. 11 is a view like FIG. 10 but showing the parts in displaced positions.

When the secondary key 53 has been introduced and rotated, the resulting concurrent rotation of the lobe 57 causes the plate 63 to rock into the solid-line position shown in FIGS. 6 and 11. This moves the tang 67 from its normal position (FIG. 3) just below and blocking clockwise rotation of a quadrant 76 forming part of a rotatable sector 77. The sector 77 is a substantial duplicate of the cam plate 56 and has a lobe 78 that may customarily rest against the stud 68. The sector 77 is in central engagement with a flattened lock bar 79 (FIGS. 3 and 6) extending from the plug 43 for the primary key 44. In the position of the sector 77 shown in FIGS. 3, 6 and 10, for example, the primary key 44 can be neither rotated nor withdrawn because the quadrant 76 of the sector 77 is non-rotatably blocked against the tang 67 on the generally upright pivot plate 63.

Clockwise rotation of the pivot plate 63, if unblocked and free, can be accomplished by rotation of the secondary key 53 and of the lobe 57 moved by that key, but such movement cannot be accomplished by the secondary key 53 alone. The pivot plate 63 cannot be moved or swung until another signal is received in the mechanism to permit moving the blocking tang 67 out of the way. The pivot plate 63 has a bent-over ledge 82 (FIGS. 2 and 4) projecting from the upper edge of the plate 63 through an opening 80 (FIG. 4) in the intermediate plate 14. In the path of rotation of the ledge 82 with the intermediate plate 63, there is a normally upstanding, reciprocable plunger 83 of an electrically operated solenoid 86. A spring 87 (FIG. 2) usually keeps the plunger 83 projected into the path of the ledge 82. The solenoid is secured to a channel 88 held by fastenings 89 (FIG. 4) to the intermediate plate 14.

The conductors for the solenoid are flexible and of substantial length so that removal and replacement of the solenoid with its mounting can easily be effected. Associated with the solenoid and its electrical supply is a circuit board (not shown) conveniently mounted against the securing plate 7 and adjacent the solenoid or, in some cases, at a remote point, but in any case providing for specially coded operation of the solenoid. Also in the electrical circuitry is an indicator light 90 effective to show either that the entire device is available for operation or that an incoming electrical releasing signal has been received.

With this arrangement, when the solenoid is not energized and the spring 87 therefore is fully effective, the projected solenoid is in the path of the ledge 82 and plunger 83 precludes any substantial rocking of the pivot plate 63, and the pivot plate tang 67 acts as a barrier against rotation of the quadrant 76. But when there is an electrical signal to the solenoid 86, the plunger 83 is withdrawn, compressing the spring 87 and moving the plunger out of the rotary path of the ledge 82 on the pivot plate 63. Then while the solenoid plunger is withdrawn and the pivot plate 63 is still in its dotted-line position as shown in FIG. 6, the secondary key 53 can be rotated, carrying with it the cam plate 56, thereby rocking the plate 63 into the full-line position of FIG. 6. This moves the ledge 82 past the withdrawn plunger 83 and carries the tang 67 out of the way of the quadrant 76. Thus, the bar 79 is freed for rotation with the quadrant 76 by the primary key 44 since the tang 67 is well out of the way of the quadrant. When the associated plug 43 is thus appropriately rotated through approximately 30 degrees, as shown in FIGS. 10 and 11, the corresponding detent bar 34 projects into its corresponding notch 36 and the primary key 44 can be fully withdrawn from its key plug 43. The key 44 then can be withdrawn and independently used to gain access to the lock of another structure.

In this way there is provided an arrangement with normally stores a primary key in a public location ready for use but retained against withdrawal until a secondary key has been operated and until a second signal such as an electrical impulse has simultaneously occurred.

I claim:

1. A safety key holder comprising a frame, means on said frame for receiving a primary key, a sector on said frame for rotating into and out of a position for retaining said primary key in said primary key receiving means, a plate on said frame movable into and out of a position for preventing rotation of said sector out of said key retaining position, a first coil spring for urging said plate into said position, a plunger on said frame for moving into and out of a position blocking movement of said plate, a spring for urging said plunger into said position, electrical means on said frame and effective when energized for moving said plunger fully out of said blocking position, and means remotely controlled and connected to said electrical means from outside said frame for energizing said electrical means.

2. A safety key holder as in claim 1 in which said plate is moved against the urging of said first coil spring by a secondary key and said electrical means is a solenoid coil around said plunger.

3. A safety key holder comprising a case having an open side, a panel having openings therein, said panel being adapted to close said open side, a primary key plug within said case and extending through one of said openings for receiving a primary key, a pivot plate within said case and movable in said case by a secondary key between a first position for retaining said primary key in said primary key plug and a second position for releasing said primary key from said primary key plug, means for urging said pivot plate toward said first position, a fastener within said case and accessible through another of said openings for removably securing said panel with said primary key plug to said case, means formed in a movable means for blocking and unblocking access to said fastener through said another of said openings, a plunger, a spring urging said plunger into position blocking movement of said pivot plate, and means actuated electrically and controlled from outside said case for moving said plunger against said spring and out of said position.

4. A safety key holder as in claim 3 in which said movable means is effective to unblock said access only when said movable means is in a second position to release said primary key.

5. A safety key holder comprising a frame, a primary key plug rotatable on said frame between a key retaining position and a key releasing position, means shiftable on said frame between positions blocking and unblocking rotation of said primary key plug between said retaining position and said releasing position, a first spring for urging said shiftable means toward said blocking position, a secondary key operated means on said frame for shifting said shiftable means between said blocking position and said unblocking position, electrical means controlled from outside said frame and movable on sad frame into and out of a position blocking movement of said shiftable means, and a second spring urging said electrical means into said position.

6. A safety key holder as in claim 5 in which said electrical means includes a solenoid core movable relative to said frame and a solenoid coil fixed on said frame.

7. A safety key holder as in claim 5 in which said electrical means includes a solenoid including a coil and a core, said coil when energized being effective to move said core relative to said frame and out of the path of said shiftable means between said blocking position and said unblocking position.

8. A safety key holder comprising a frame closed except for an open side, a plate adapted to fit said side and close said frame, a primary key plug rotatably mounted on said plate, a primary key receivable within and rotatable with said primary key plug between a first position in which said primary key is retained in said primary key plug and a second position in which said primary key is withdrawable from said primary key plug, a secondary key plug rotatably mounted on said plate, a secondary key receivable within and rotatable with said secondary key plug between one position and another position, a pivot plate, means for mounting said pivot plate in said frame for movement in a predetermined path between a first position blocking rotation of said primary plug and a second position unblocking said rotation of said primary plug, a spring urging said pivot plate toward said blocking position, means actuated by said secondary key plug for so moving said pivot plate, a solenoid core, means for mounting said solenoid core in said frame for movement in a path between one position blocking said movement of said pivot plate and another position out of said path, a spring for urging said solenoid core into said blocking position, and a solenoid coil on said frame and included in a circuit extending outside said frame and effective when energized for moving said solenoid core into said other position out of said path.

* * * * *